United States Patent [19]

Chamieh

[11] Patent Number: 4,859,102

[45] Date of Patent: Aug. 22, 1989

[54] CONTOURED CLEANING DEVICE

[76] Inventor: Naji Chamieh, 13206 Summertime La., Culver City, Calif. 90230

[21] Appl. No.: 165,238

[22] Filed: Mar. 7, 1988

[51] Int. Cl.[4] ..... A46B 11/06

[52] U.S. Cl. ..... 401/17; 401/23; 401/24; 401/36; 401/42; 401/45; 401/46; 401/136; 401/204; 401/289

[58] Field of Search ..... 401/136, 289, 203, 204, 401/17, 22, 23, 24, 36, 39, 42, 43, 44, 45, 46, 47, 37

[56] References Cited

U.S. PATENT DOCUMENTS

| | | | |
|---|---|---|---|
| 176,169 | 4/1876 | Davies | 15/176 |
| 794,638 | 7/1905 | Payn | 401/46 |
| 873,550 | 12/1907 | Hudson | 401/39 |
| 1,219,504 | 3/1917 | Summer | 401/39 |
| 1,486,722 | 3/1924 | Bernat | 401/287 |
| 1,561,304 | 11/1925 | Bell-Irving | 401/286 |
| 1,975,643 | 10/1934 | Levin | 401/24 |
| 2,652,850 | 9/1953 | Manville | 401/46 X |
| 2,658,219 | 11/1953 | Torbert | 401/204 X |
| 2,801,435 | 8/1957 | Savona | 401/46 |
| 2,879,532 | 3/1959 | Szabo | 15/114 |
| 3,052,910 | 9/1962 | Kushner | 15/176 |
| 3,617,139 | 11/1971 | Ross | 401/201 |
| 4,618,279 | 10/1986 | Gurevich et al. | 401/46 X |

FOREIGN PATENT DOCUMENTS

| | | | |
|---|---|---|---|
| 566875 | 6/1931 | Fed. Rep. of Germany | 401/39 |
| 875636 | 8/1961 | United Kingdom | 401/46 |
| 926504 | 5/1963 | United Kingdom | 401/46 |

*Primary Examiner*—Steven A. Bratlie

*Attorney, Agent, or Firm*—Drucker & Sommers

[57] ABSTRACT

A hand-held cleaning implement. An ergonomically shaped, hand-held body allows attachment of a brush and sponge. The body is provided with a first and a second digitally operated valve button that allows water, provided by an external source, to flow through the brush or the sponge, at the user's option.

12 Claims, 1 Drawing Sheet

CONTOURED CLEANING DEVICE

BACKGROUND OF THE INVENTION

This invention relates to hand-held cleaning implements.

Two favorite hand-held cleaning implements are the scrub brush and sponge. The scrub brush loosens hardened grime by abrasion. The sponge allows fluid application and grime removal, applying a cleaning fluid to a soiled surface and removing it to clean the surface. Both implements are preferably used with a cleaning fluid, usually water with soap. Therefore, a variety of methods have been used to provide water to soiled surfaces.

Kushner, in U.S. Pat. No. 3,052,910, teaches an implement whereby a sponge and scrub brush are mounted on the top of a squeeze bottle. The bottle is a fluid reservoir and the handle of the apparatus.

U.S. Pat. No. 2,879,532 to Szabo, teaches a utility brush and sponge. An elongate handle supports a two-sided head, the first side has a sponge, the second, a brush. Although it teaches the provision for carrying soap, it does not teach provision for flowing water.

U.S. Pat. No. 1,561,304 to Bell-Irving teaches a device with two brushes, the smaller of the two having a connection to a fluid-containing bottle.

U.S. Pat. No. 1,486,722 to Bernat shows a brush with a handle and means of providing a cleaning fluid, the preferred one being steam.

U.S. Pat. No. 2,801,435 to Savona, U.S. Pat. No. 176,169 to Davies, et al., and U.S. Pat. No. 3,617,134 to Ross, all show arrangements to permit water to flow to a cleaning implement.

It would be advantageous to provide a cleaning implement supplying flowing water, electively, to both, a sponge and brush that is valveably controllable.

It would be particularly advantageous to have an ergonomic device that fits the natural contours of the human hand that supports cleaning implements that are supplied with flowing water.

SUMMARY OF THE INVENTION

This invention provides a hand-held cleaning implement. An ergonomically shaped, hand-held body allows attachment of a brush and a sponge. The body is provided with a first and a second digitally operated valve button that allows water, provided by an external source, to electively flow through the brush or the sponge at the user's option.

An aspect of this invention is:

A cleaning apparatus comprising:

an ergonomically shaped body part having:

- a handle joining the body part;
- an attachment for a sponge;
- an attachment for a brush;
- a means for providing flowing water to the body;
- a first valve controlling water flowing between means for providing flowing water and said attachment for said sponge; and
- a second valve controlling water flowing between means for providing flowing water and said attachment for said brush;

a sponge attached to said attachment for a sponge; and a brush attached to said attachment for a brush.

DETAILED DESCRIPTION

Figure 1:
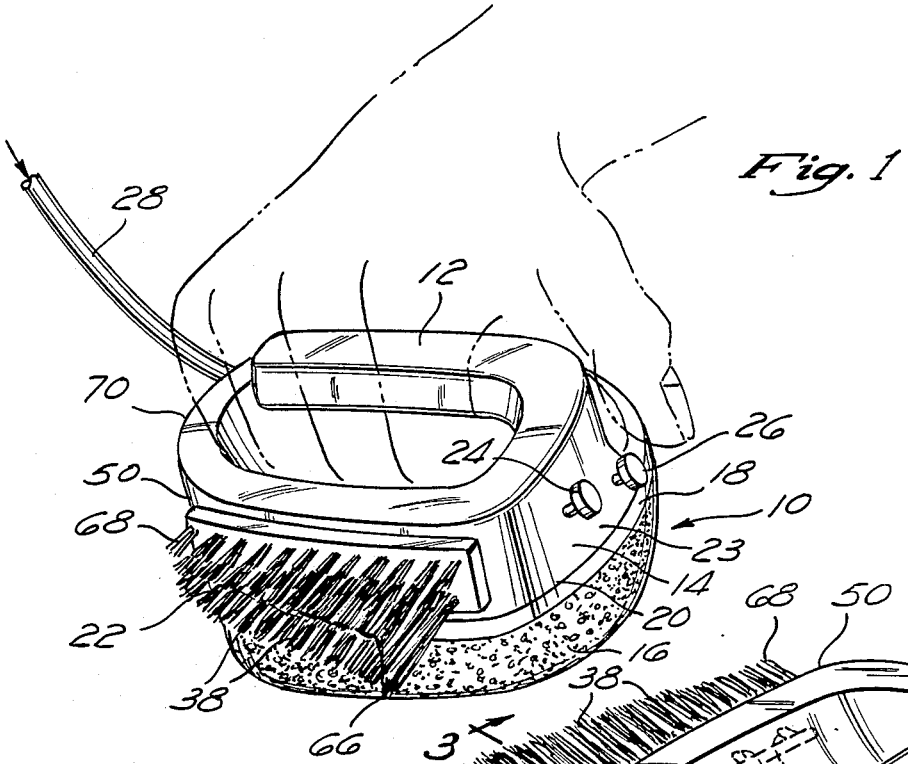
FIG. 1 shows a top left perspective view of the one preferred embodiment of the cleaning implement of the present invention.

Referring to FIG. 1, a cleaning implement 10 is held by a hand (shown in phantom). A handle 12 attaches to an ergonomically shaped cleaning implement body 14. A sponge 16 is attached to a support plate 18, itself attached to a first attachment for a cleaning device 20. A scrub brush 22 is attached to a second attachment for a cleaning device. The brush and the sponge can both be used to clean a soiled workpiece.

The ergonomically shaped cleansing implement body 14 is shaped so that a right hand (as shown) can grip the handle 12, with knuckles facing the brush 22, and the thumb pointing toward a first digitally operated valve button 24 and a second digitally operated valve button 26. Of course, the mirror image body can be made for use by the left hand.

A hose 28 leads from the ergonomically shaped cleaning implement body 14 to a water supply means (not shown). By this means, flowing water is provided to the cleaning implement body.

The brush 22 is elongate, defining a length and a first end 66 and second end 68. The first end of the brush is proximate the first and second digitally operated valve buttons. The second end of the brush is proximate the hose end 70 of the ergonomically shaped body. It is preferred that the bristles of the first end of the brush be relatively longer than the bristles of the second end of the brush. The brush is then useful for scrubbing in interior corners and the like.

Figure 2:
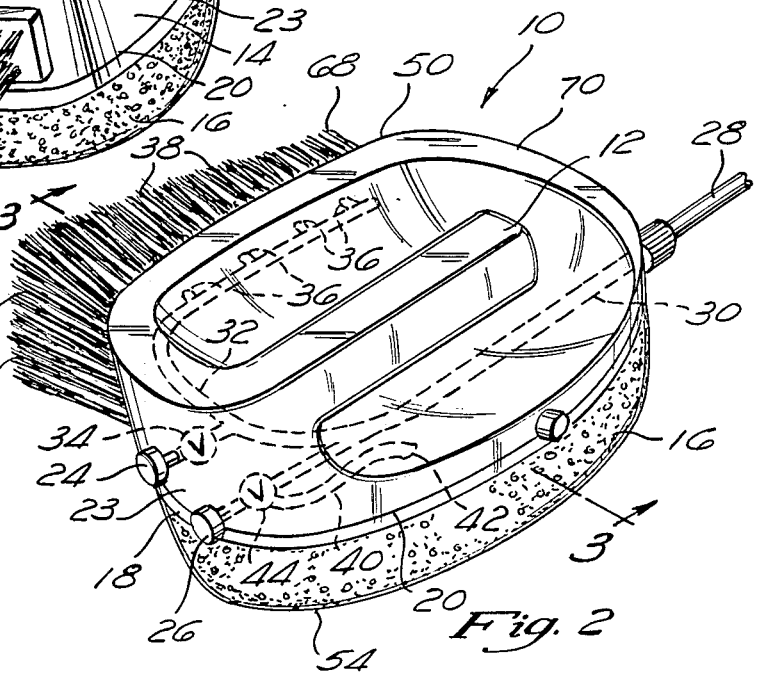
FIG. 2 shows a top right perspective view of the cleaning implement shown in FIG. 1.

Referring to FIG. 2, the handle 12 is unitarily molded with the body. The body defines a relief around the handle that allows fingers to grasp the handle and receive the knuckles of the hand.

The flowing water from the hose 28 feeds water into the hose passageway 30 in the body. A first passageway 32 conducts water when a first valve 34 is opened by manipulation of the first digitally operated valve button 24. A plurality of water orifices 36 allows water from the first passageway to flow through the bristles 38 of the brush 22. The alternative embodiment places the water orifices below the bristles of the brush.

Water flows through a second passageway 40, which terminates in a central water passageway 42, when a second digitally operated valve button 26 is manipulated opening a second valve 44.

The bottom surface 20 of the ergonomically shaped body is circular in the plane parallel to the plane of the soiled workpiece the sponge is cleaning. The brush side 50 has a brush attachment surface that rises perpendicularly from the plane of the sponge support. The surface curves inwardly to form the button side 23. The curve continues over the sponge support forming the handle 12. The curve of the handle allows comfortable fit and natural access for the thumb over the first valve button 24 and the second valve button 26. Although the handle is shown attached at only one end to the body, it can be attached at both ends.

Figure 3:
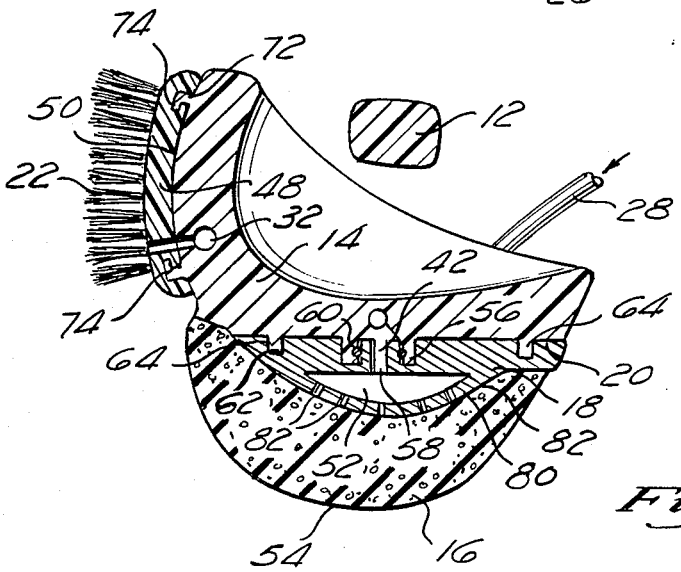
FIG. 3 shows a section view along the line 3—3 in FIG. 2.

Referring to FIG. 3, the ergonomically shaped body 14 and the handle 12 define a relief to accommodate the users' fingers and knuckles. The brush attachment 48 is on the side surface 50 of the body. The sponge support plate 18 is on the bottom surface 20 of the body.

The sponge 16 defines a means for containing soap 52 that is a cavity between the cleaning surface of the sponge 54 and the sponge support plate 18. The cavity preferably contains cleaning material, preferably either fluid or solid soap. Water is conducted to the interior cavity by the second passageway 40. The water flows through the second passageway in from the hose, past the open second valve 44 and into the central water passageway 42. The central water passageway has an extended edge 56 that mates with a center aperture 58 defined by the sponge support plate. An "O" ring gasket 60 provides a watertight seal.

A twist-lock holds the sponge onto the sponge attachment on the body. The body has integrally formed twist lock receivers 62. The support plate has integrally molded twist lock mating receivers 64. By removing the sponge 16 from the ergonomically shaped body 14, soap or other material can be placed in the means for containing soap.

In one embodiment, the sponge is attached, by adhesive means to a sponge backing 80. A plurality of fluid passageways 82 allows water and cleaning solution, if used, to pass through to the sponge. The cleaning solution can be a liquid type cleanser or solid cleanser that is loaded into the means for containing soap 52 by passing it through the center aperture when the sponge is unattached to the body.

It is preferred that the brush be removeably mounted. The side surface 50 of the body has receiving rails 72 that engage a mating rail 74 on the back end of the brush 22. Then the brush can be replaced as the bristles wear down or become soiled.

In operation, the user holds the handle with his thumb toward the first digitally operated valve button 24 and the second digitally operated valve button 26. The user can, at his option, open either the first valve or the second valve by thumb pressure on the appropriate digitally operated valve button. Water flows from the hose to the brush, if the first valve has been actuated, or to the sponge, if the second valve has been actuated.

The ergonomic shape of the cleaning implement allows the user to use either the scrub brush or the sponge without changing his grip. The user is thereby allowed to use, at his option, either a brush or a sponge, both provided with flowing water.

Variously shaped brushes and sponges can be interchanged. In one embodiment both the first attachment for a cleaning device and the second attachment for a cleaning device are attached to scrub brushes. In this manner the cleaning implement can be customized for particular cleaning jobs.

Although one embodiment of the present invention has been described, obvious variations can be made, by those skilled in the art. Therefore, applicant wishes his invention to be limited only by the appended claims.

I claim:

1. A cleaning apparatus comprising:

an ergonomically shaped body part, having:

a handle joining said body part said ergonomically shaped body part and handle being molded as one piece, said body part defining a recess around said handle adapted to receive the knuckles and fingers of a hand for gripping said handle, and whereby the thumb of said hand extends outwardly of said body part;

a first cleaning device attached to said body part;

a second cleaning device attached to said body part;

a means for providing flowing water to said body part;

a first valve controlling water flowing between said means for providing flowing water to said body part and said first cleaning device;

a second valve controlling water flowing between said means for providing flowing water to said body part and said second cleaning device; and thumb-operable means controlling said first valve and said second valve.

2. The cleaning apparatus of claim 1, wherein said first cleaning device is a sponge.

3. The cleaning apparatus of claim 1, wherein said second cleaning device is a brush.

4. The cleaning apparatus of claim 1, wherein said first cleaning device is removably attached to said body part.

5. The cleaning apparatus of claim 4, wherein the removable attachment for said first cleaning device is a receiving rail on the body with a mating rail on said first cleaning device.

6. The cleaning apparatus of claim 4, wherein a removable attachment for said second cleaning device is a receiving rail on the body with a mating rail on said second cleaning device.

7. The cleaning apparatus of claim 4, wherein the removable attachment for said first cleaning device includes a twist lock.

8. The cleaning apparatus of claim 1, wherein said ergonomically shaped body part includes a means for containing soap.

9. The cleaning apparatus of claim 1, wherein said second cleaning device is removably attached to said body part.

10. The cleaning apparatus of claim 1, wherein said handle is joined to said body part at one end only of said body part.

11. The cleaning apparatus of claim 1, wherein said first valve is controlled by a first valve button and said second valve is controlled by a second valve button.

12. The cleaning apparatus of claim 1, wherein said first valve is controlled by a first valve button and said second valve is controlled by a second valve button, said valve buttons being placed adjacent each other whereby either of said valve buttons are readily thumb-operable by a user of said cleaning apparatus.

* * * * *